United States Patent [19]

Stewart

[11] 3,938,570

[45] Feb. 17, 1976

[54] DUAL PURPOSE CLUB HEAD COVER

[76] Inventor: Edra J. Stewart, 1404 Paula Drive, Apopka, Fla. 32703

[22] Filed: June 28, 1974

[21] Appl. No.: 484,343

[52] U.S. Cl. ..... 150/52 G; D34/5 GC; 15/247; 206/457; 273/32 A

[51] Int. Cl.[2] ..... A63B 57/00; B65D 65/02

[58] Field of Search..... D34/5 GC, 5 GB; 15/21 A, 15/247; 150/52 G; 273/32 B, 162 R, 162 F

[56] References Cited

UNITED STATES PATENTS

| | | | |
|---|---|---|---|
| 2,526,985 | 10/1950 | Whithead | 150/52 G |
| 2,925,840 | 2/1960 | Hird | 150/52 G |
| 3,426,815 | 2/1969 | Ashlin et al. | 150/52 G |
| 3,774,913 | 11/1973 | Dien | 273/32 B |
| 3,831,652 | 8/1974 | Hyden et al. | 150/52 G |

*Primary Examiner*—William Price
*Assistant Examiner*—Steven E. Lipman
*Attorney, Agent, or Firm*—Julian C. Renfro

[57] ABSTRACT

A novel dual purpose golf club head cover that not only serves to protect a club head from rusting, and becoming scratched or chipped, but also provides an ample skirt of absorptive material that the golfer can use for wiping his ball, club or hands. This invention finds particular application in connection with putters, for when on the green and his ball is in need of cleaning, the golfer can clean his ball as well as his putter without soiling his clothing, despite the fact that he is separated from the golf cart and the towel customarily found thereon.

6 Claims, 15 Drawing Figures

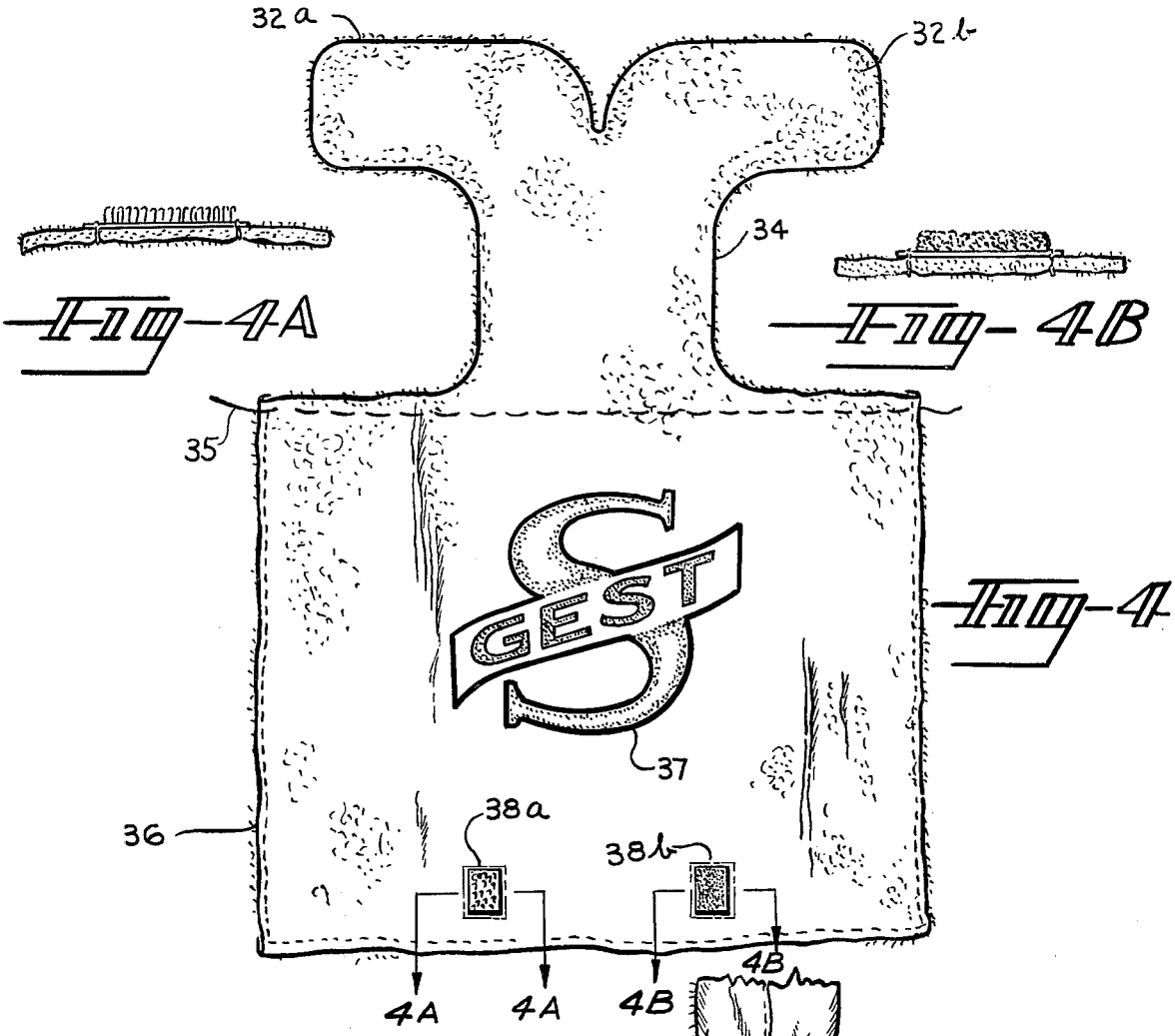
Fig-4A
Fig-4B
Fig-4
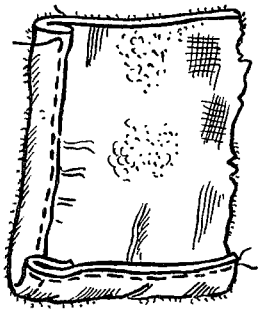
Fig-5A
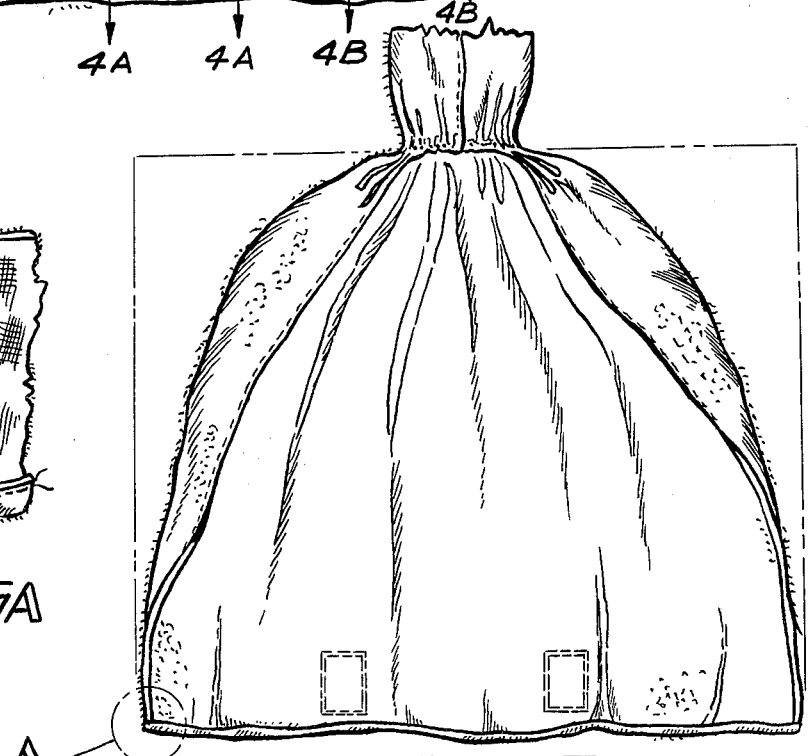
Fig-5

DUAL PURPOSE CLUB HEAD COVER

BACKGROUND OF THE INVENTION

This invention pertains to a golf club head cover in the general nature of the protective devices utilized by golfers in order to protect their clubs from physical damage as well as from the elements. However, these prior art devices were intended to serve no other purpose than to prevent collision between adjacent clubs, to lessen the tendency of the clubs to rust, and in some instances to identify the individual clubs.

SUMMARY OF THE INVENTION

Golfers for many years have utilized a variety of protective coverings for their clubs, with most golfers preferring to use individual devices on the heads of their clubs in order to minimize undesirable contact between the clubs during the time they are being transported. These coverings have been made of many different materials, including leather, plastic, cloth, and the like, and often are of a decorative nature so as to enhance the appearance of the golfer's bag.

Many golfers carry a towel that is removably secured to their golf bag so that they will have a ready means for wiping their ball and clubs from time to time, as well as their hands in the event they become muddy or wet from perspiration. In addition, other golfers having frequent need for the use of a towel carry a towel on their belt. However, in the event of a lady golfer, who may not be wearing a belt, the carrying of a towel may become burdensome, and she therefore tends to leave the towel fastened to her bag, golf cart or the like.

As is known, golf carts and other wheeled devices are forbidden to travel on the greens of most if not all golf courses, and this of course means that any golfer that is not carrying a towel on his or her person may leave the cart on a nearby cart path and then walk onto the green before realizing that he or she is in need of a means for wiping the ball. Conditions making it essential to clean the ball are wet greens, wet sand in traps, and fertilizer on the greens. As is also known, when on the green it is permissible to use a ball marker to mark the spot where the ball lies, lift the ball, and then proceed to wipe same before putting. However, at this point, if the towel has been left on the cart, any convenient item of clothing or even putting the ball to the mouth becomes the means by which most golfers proceed to clean their ball, for to return at this point to the cart for the towel means that golfing companions as well as the following party will be delayed.

Therefore, in accordance with this invention, I have provided a novel dual purpose golf club head cover that not only protects the club to which it is applied, but also provides a full skirt portion that serves as an ideal means for wiping the hands, the club and the ball. Although not limited to being used on any particular club, my invention is ideally suited for use on the putter in that, as previously mentioned, the golfer is often separated from his or her towel when on the green, and when the ball is on the green is of course the very time that it is particularly desirable to have a towel for wiping the ball.

The novel golf club head cover in accordance with my invention involves a head-engaging portion, a narrowed "waist" portion, and an elongate skirt portion that may hang loosely around a considerable portion of the length of the shaft of the club, or alternatively may be fastened in closely surrounding relationship around the shaft. Velcro or other quick fastening means may be utilized in order to cause the skirt to furl around the club shaft when the club is not in use.

By constructing my novel club head cover of terry cloth or other appropriate washable material such as toweling, not only is damage to the club head prevented, but the club cover itself becomes a ready means for enabling the golfer to prepare for putting. Then, after the game is over, the cover can be removed, washed, dried, and thereafter returned to the club head.

Advantageously, the skirt portion is of substantial enough size as to provide ample room for a club or organizational emblem, or to serve as a support for various advertising, thus making it possible for the management of a golf course or a manufacturer to obtain free advertising by distributing decorative golf club covers in accordance with my invention to its patrons.

It is therefore a principal object of my invention to provide a novel dual purpose golf club head cover.

It is another object of my invention to provide a golf club head cover that not only protects the club upon which it is utilized from many different types of damage, but also enables the golfer to keep suitable toweling close by at all times, especially when he is on the green and separated from his or her golf bag.

It is still another object of my invention to provide a low cost yet highly effective golf club head protector and ball cleaning device that is of large enough size as to enable it to bear a club emblem or serve as a support for advertising.

It is yet still another object of my invention to provide a golf club head cover that is effective for two or more purposes, attractive in its appearance, of low cost, and reusable after washing.

These and other objects, features, and advantages will be more apparent from a study of the appended drawings in which:

FIG. 1A and FIG. 1B are cross sectional views showing a typical manner in which the material constituting the cover is hemmed;

FIG. 4 is a view of the novel club cover after it has been cut out of absorbent, washable material, but before it has been sewn together;

FIG. 4A and 4B are cross-sectional views taken along lines 4A — 4A and 4B — 4B in FIG. 4 in order to reveal the velcro portions that may be used in order that the skirt may on occasion be maintained in a furled position;

FIG. 5 is a side elevational view of the skirt, showing the manner in which it is gathered at the "waist" by use of elastic or the like in order to inhibit displacement of the cover from the head of the club;

FIG. 5A is another view of hem detail of the skirt of FIG. 5;

DETAILED DESCRIPTION

Figures 1, 2, 3:
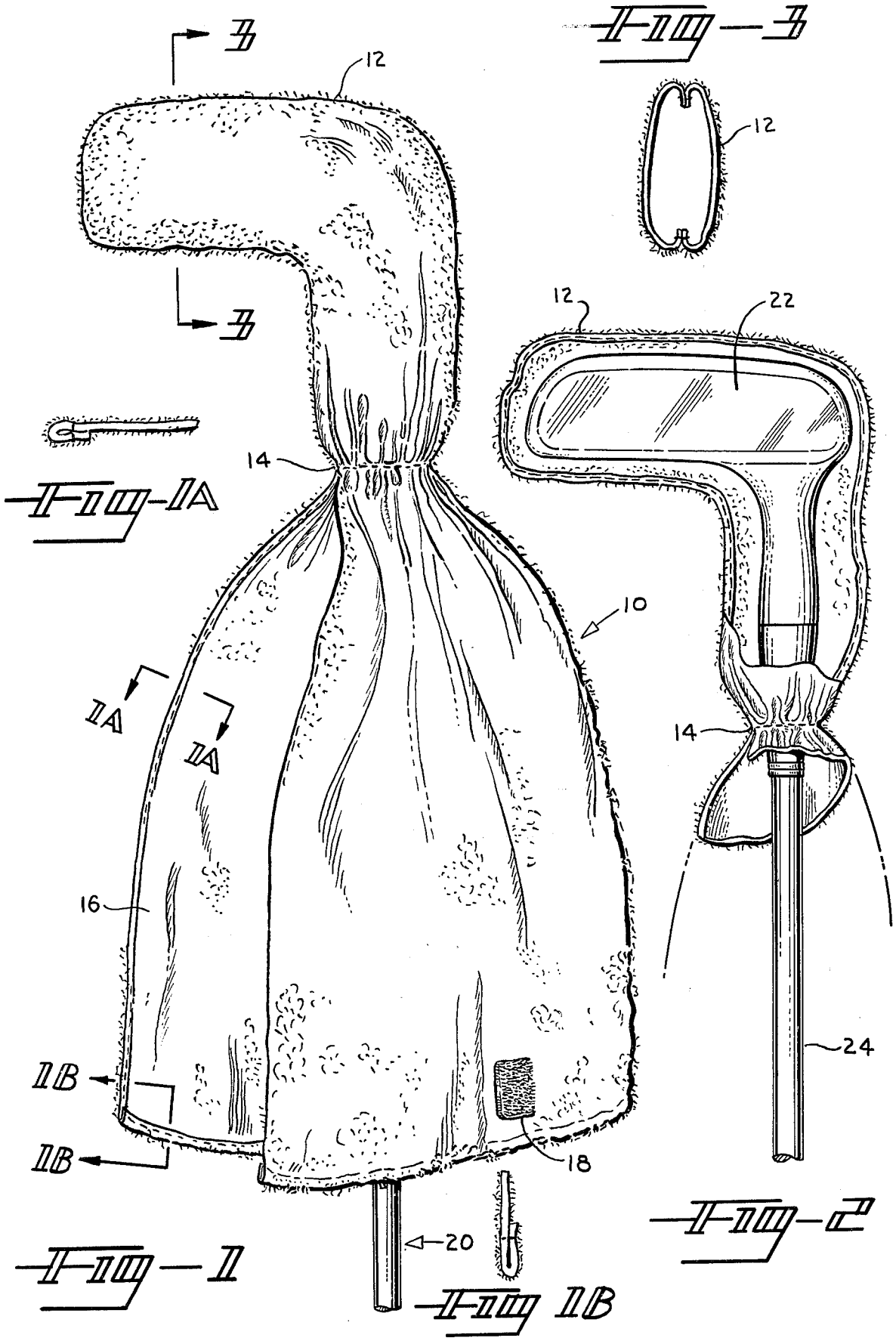
FIG. 1 is a side elevational view of my novel golf club head protector in position on a club, showing the elongate skirt in full position.
FIG. 2 is a side elevational view generally along the lines of FIG. 1, but with portions of the head cover removed to reveal internal configuration, and the head of a putter.
FIG. 3 is a cross sectional view taken along lines 3 — 3 in FIG. 1 in order to reveal internal construction of the head portion of the club cover, but without the club in place.

Turning to FIG. 1, it will there be seen that I have shown a primary embodiment of my dual purpose club cover 10, which cover involves a club-head-engaging portion 12, a narrowed "waist" portion 14, and an elongate skirt portion 16. The cover 10 is of course designed to fit upon a golf club, such as a putter 20, with the skirt portion 16 typically being of such size as to be able to extend away from the shaft 24 of the club to a considerable extent, as indicated in FIG. 1.

FIG. 2 reveals how the club-head-engaging portion 12 fits closely around the head 22 of the club, and how the "waist" portion 14 rather closely fits around the shaft 24 of the club. Elastic material may be sewn into the cover at the "waist" location 14, as indicated in FIGS. 1 and 2, in order that the head portion 12 of the cover will fit snugly around the club head 22, and resist dislodgment. This use of elastic or stretch thread is by way of example only, for other arrangements, such as a draw string can be used instead, if such be preferred.

The skirt portion is of ample dimensions, so as to be usable for wiping a golf ball or club prior to putting, for example, and may be employed in the manner of a towel either while installed on the club, or after it has been removed therefrom. Typically, the skirt portion extends away from the head-engaging portion 12 for a distance approximately equal to or greater than a major dimension of the head-engaging portion, such as a left-right dimension of the portion 12 shown in FIG. 1. In the usual instance, the golfer removes the cover 10 from the club, wipes the ball, and then proceeds to putt, in that order. By virtue of the disclosed arrangement, the golfer always has a ball-wiping means conveniently available just before putting, despite the fact that he or she is on the green and therefore separated from the towel customarily to be found on the golf bag or golf cart. FIG. 1 also reveals the fact that I may wish to use Velcro on the skirt, as at 18, in order to make it possible to furl the skirt.

FIGS. 1A and 1B reveal hem details, and may be seen to involve turkish cloth, terry cloth or other toweling type material, in which a hem may or may not be used. As is obvious, the cover should be of washable material.

FIG. 3 reveals a cross-section of a typical head-engaging portion of my novel cover, and as there will be noted, I prefer to stitch the portions constituting the left and right halves of the cover together, using internal seams.

Turning to FIG. 4, it will there be seen that I have illustrated a typical club cover after it has been cut out of toweling or other absorbent, washable material, but before it is sewn together to create the configuration shown and discussed earlier. As will be apparent, the club head-engaging portions involve left and right elongate portions 32*a* and 32*b* that are sewn together in the manner previously mentioned, in order to create an enclosure that fits in a close and appropriate manner around the head of the club. Quite obviously, the portions 32*a* and 32*b* would be of suitably larger dimension if intended for use on a club larger than a putter. The neck portion 34 must of course be large enough to permit entry of the club head. Inasmuch as I prefer to have a waist portion that is elasticized, I sew elastic, or preferably stretch-thread along the top edge 35 of the skirt, before proceeding to sew the edges of the halves of the head portion together. The skirt portion 36 may be generally rectangular as shown in FIG. 4, although it may be shaped differently in order to achieve the amount of fullness desired. Complimentary pieces of Velcro 38*a* and 38*b* may be secured at suitable locations near the hem of the skirt portion, such that upon the sides of the skirt being brought together, the velcro portions will interfit and hold the skirt in a properly furled manner. An emblem such as shown at 37 in the example revealed in FIG. 4 may be sewn, glued, or otherwise attached to or employed on the skirt. Advertising of various forms may also be used.

FIG. 4A and FIG. 4B show the complimentary types of velcro used, which serve to hold the skirt on occasion in the furled position. FIG. 5 reveals the skirt portion of my device after the top has been drawn together, such as by the use of stretch thread, elastic or the like. This arrangement makes it possible to have on the one hand an ample amount of skirt material, and on the other hand a tight enough "waist" portion as to prevent displacement of the upper part of the cover from the head of the club.

Figures 6, 7, 8, 9, 10:
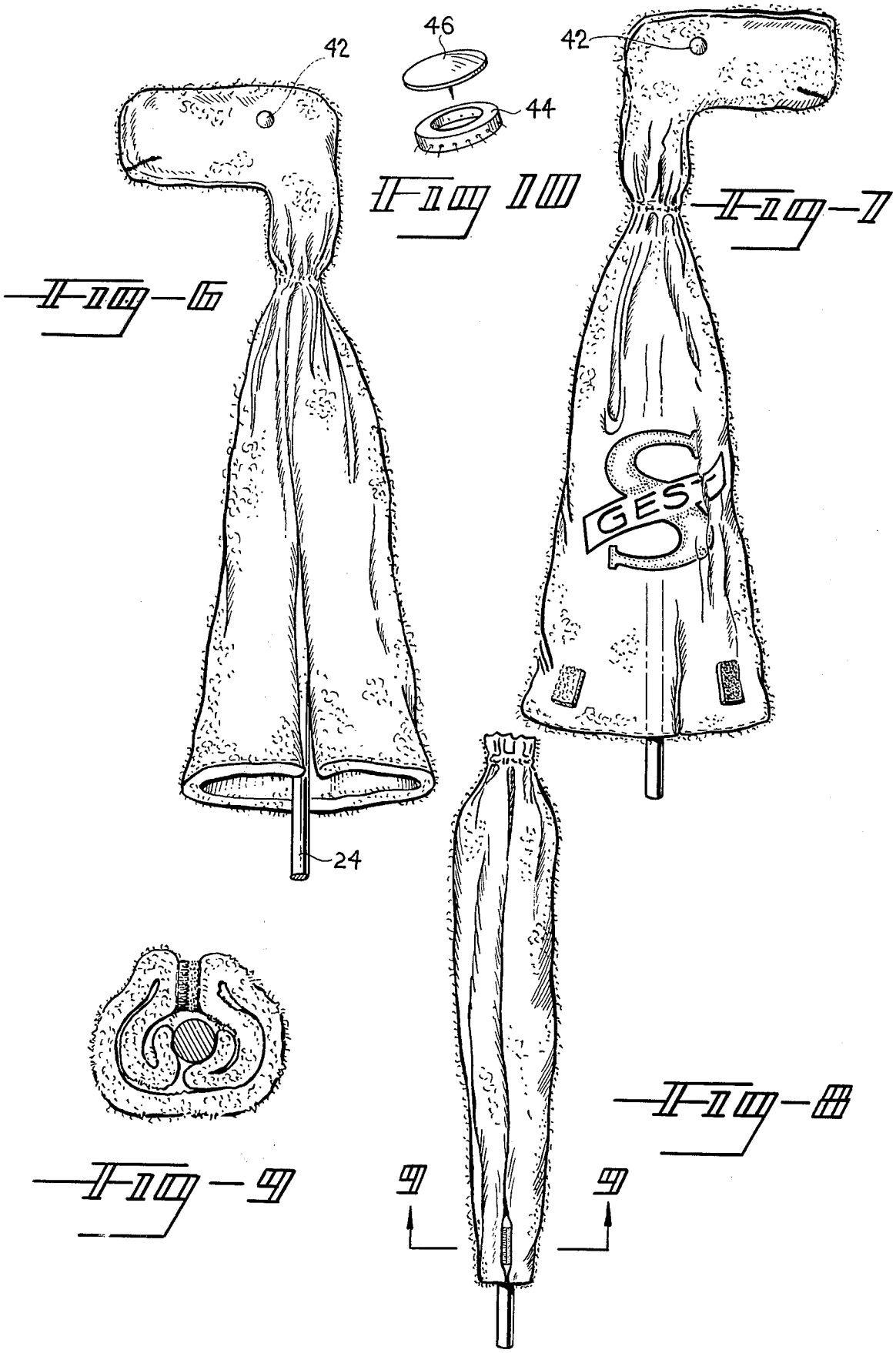
FIG. 6 is a side elevational view to a smaller scale than FIG. 1, in which view the skirt does not closely surround the shaft of the club.
FIG. 7 is a view differing from FIG. 6 in that the club head has been turned 180° in order to reveal the emblem that may be used on the skirt, and the velcro that may be employed.
FIG. 8 is a view of the skirt in which the velcro portions have been brought closely together and joined so as to cause the skirt to remain in a closely furled position.
FIG. 9 is a cross sectional view taken along lines 9 — 9 in FIG. 8 and revealing the manner in which the skirt closely clings to the club shaft when the velcro portions have been joined.
FIG. 10 is an exploded view to a larger scale of a ball-marker arrangement that may be used on the head-engaging portion of my novel cover.

FIG. 6 reveals the skirt portion of my novel cover in a position residing down along the shaft 24 of the club. As will be apparent, the skirt extends at least one club head length below the "waist" portion, and for example, the skirt may be two or three club heads in length, or more.

FIG. 7 shows the club turned 180° in order to reveal the utilization of the club emblem on the skirt, and the use of velcro in order that the skirt can be closely furled around the shaft of the club.

In the showing in accordance with FIG. 8, the velcro portions on the skirt have been brought together and joined so as to cause the skirt to reside around the shaft in a closely fitting manner. Note FIG. 9 wherein the manner in which the skirt is folded or furled is revealed in considerable detail.

It is to be noted that the velcro can be so located that the skirt portion of my novel cover can extend around a plastic tube of the type frequently used in golf bags, and the cover fastened around the outside of the tubes. This would be done at the time the clubs are being put away. Then, when the club is to be used again, the velcro portions are pulled apart, thus to release the plastic tube so the club can be removed from the bag.

If stretch thread is used at 35, it may be applied by hand or by a sewing machine, with the stitching preferably being accomplished from the "wrong" side of the material. Then, the sewing of the head-engaging portion of the cover is commenced, typically at the waist portion, working toward the head portion. However, there is no reason why the part of the head portion remote from the waist could not be sewn first. Typically, the sewing of the left and right halves 32*a* and 32*b* stops short of the elasticized portion. After the stitching is complete, the head-engaging portion 12 is turned inside out to expose the exterior of this portion.

The sewing being accomplished, the ends of the stretch thread are grasped and pulled so as to bring about a gathering of the top of the skirt portion, thus to create the gathering shown in detail in FIGS. 1, 2 and 5. Typically, the waist portion 14 is a club head length down from the uppermost edge of the head portion 12.

Although I could use other means than elastic at the waist to prevent displacement of the head portion 12 from the head of the club, I prefer the use of elasticized means inasmuch as it makes it possible for the player to remove the cover or replace same in a minimum of time.

As shown in FIGS. 6 and 7, the head portion of the cover may be provided with "eyes" 42 in the form of ball markers held in the appropriate positions by suitable means such as by the use of ring shaped magnets sewn or otherwise attached to the cloth of the cover. FIG. 10 shows a magnet 44 and a ball marker 46, latter being of ferric metal, or at least having ferric metal in the location that contacts the magnet. To use, the ball marker is pulled away from the magnet, and then later replaced. In the interests of economy, only the outermost portions of the members 44 need to be magnetic material.

As should now be apparent, my novel cover is a boon to most golfers in that it enables him or her to have a ball wiping means easily available on the putter, accomplished at very little expense beyond the cost of ordinary club head covers having no ball-cleaning means thereon. While the size of the skirt portion preferred may vary from golfer to golfer, most prefer skirt lengths that are from one to three times the measurement of a major dimension of the club-head engaging portion of my novel cover, as shown in FIG. 1.

I claim:

1. A dual purpose club head cover serving not only to protect the club, but also providing a means readily available to the golfer for wiping the ball and club prior to play, said cover comprising a head-engaging portion, an elasticized waist portion below said head-engaging portion adapted to grasp the shaft of the club, and a skirt portion extending below said waist portion for a considerable extent, said head-engaging, waist, and skirt portions being made from a single piece of absorbent material, said skirt portion being of a length approximately equal to or greater than the length of the head-engaging portion of said cover, thereby providing the golfer as easily available ball wiping surface, said skirt portion being of sufficient lateral dimension as to extend loosely around the shaft of the club, and means for enabling a user to secure said skirt portion in a furled condition about the shaft of the club.

2. The dual purpose club head cover as defined in claim 1 in which the single piece of absorbent material is made of toweling.

3. A dual purpose golf club cover serving not only to protect the club, but also providing a means readily available to the golfer for wiping the ball prior to play, said cover comprising a head-engaging portion, said head-engaging portion being of a dimension as to conform to the configuration of the head of the club, and a skirt portion extending below said head-engaging portion and along the shaft of the club for a considerable extent, said skirt portion being of a length approximately equal to or greater than the length of the head-engaging portion of the cover, and being of a lateral dimension sufficient to extend loosely around the shaft of the club, said head-engaging portion being made to resemble the head of an animal, and ball markers are utilized as the eyes of such head.

4. The dual purpose golf club head cover as defined in claim 3 in which an emblem is employed on the exterior of said skirt portion.

5. The dual purpose golf club cover as defined in claim 3 in which said head-engaging portion and said skirt portion are made from a common piece of material.

6. The dual purpose golf club cover as defined in claim 5 in which said common piece of material is toweling.

* * * * *